US011428217B2

(12) United States Patent
Degenhardt et al.

(10) Patent No.: US 11,428,217 B2
(45) Date of Patent: Aug. 30, 2022

(54) COMPRESSOR COMPRISING A FIRST DRIVE PART, A SECOND DRIVE PART, AND A HIGH-PRESSURE PART CONFIGURED TO MOVE IN A COUPLED MANNER BY A PISTON ROD ARRANGEMENT WHEREIN A FIRST CONTROL UNIT AND A SECOND CONTROL UNIT ARE CONFIGURED TO CONTROL A DRIVE FLUID TO THE FIRST AND SECOND DRIVE PARTS

(71) Applicant: MAXIMATOR GMBH, Nordhausen (DE)

(72) Inventors: Phil Degenhardt, Nordhausen (DE); Michael Bierwisch, Nordhausen (DE)

(73) Assignee: MAXIMATOR GMBH, Nordhausen (DE)

( * ) Notice: Subject to any disclaimer, the term of this patent is extended or adjusted under 35 U.S.C. 154(b) by 72 days.

(21) Appl. No.: 17/115,040

(22) Filed: Dec. 8, 2020

(65) Prior Publication Data

US 2021/0172428 A1 Jun. 10, 2021

(30) Foreign Application Priority Data

Dec. 9, 2019 (DE) ..... 10 2019 133 576.0

(51) Int. Cl.
*F04B 37/12* (2006.01)
*F04B 39/00* (2006.01)

(52) U.S. Cl.
CPC ..... *F04B 37/12* (2013.01); *F04B 39/0022* (2013.01); *F04B 39/0027* (2013.01)

(58) Field of Classification Search
CPC ..... F04D 25/16; F01B 17/022; F02C 6/16; F04B 35/00; F04B 25/00; F04B 35/008;
(Continued)

(56) References Cited

U.S. PATENT DOCUMENTS 1,820,236 A * 8/1931 Loud ..... F15B 7/00 417/397
3,249,289 A * 5/1966 Maglott ..... F04B 35/008 417/397

(Continued)

FOREIGN PATENT DOCUMENTS

CN 103062011 A 4/2013
DE 1025093 B 2/1958

(Continued)

OTHER PUBLICATIONS

Extended European Search Report for European Application No. 20206898.7 dated Mar. 10, 2021; 10pp.

(Continued)

*Primary Examiner* — Kenneth J Hansen
*Assistant Examiner* — Benjamin Doyle
(74) *Attorney, Agent, or Firm* — Hauptman Ham, LLP

(57) ABSTRACT

A compressor and a method for conveying and compressing a fluid into a target system. The compressor has a first drive part having a first drive piston, a second drive part having a second drive piston and at least a first high-pressure part having a high-pressure piston. The first drive piston and the second drive piston are each able to be subjected to a drive fluid piston on alternate sides controlled via a first control unit. The first drive, the second drive piston and the high-pressure piston are jointly movable axially coupled via a piston rod arrangement. The second drive part is assigned a second control unit, which is arranged after the first control unit and via which the subjecting of the second drive piston to drive fluid is able to be activated.

5 Claims, 5 Drawing Sheets

(58) Field of Classification Search
CPC .. F04B 37/12; F04B 39/0022; F04B 39/0027; F04B 9/08; F04B 9/129; F04B 9/109
USPC ... 417/16, 53, 397, 398, 399, 400, 401, 402, 417/403, 404; 91/164, 508, 151
See application file for complete search history.

(56) References Cited

U.S. PATENT DOCUMENTS 4,390,322 A * 6/1983 Budzich ..... F04B 39/0005 417/267
4,653,986 A * 3/1987 Ashton ..... F04B 9/113 417/268
4,710,104 A * 12/1987 Dring ..... F04B 9/113 417/342
4,761,118 A * 8/1988 Zanarini ..... F04B 9/115 417/396
4,902,207 A * 2/1990 Hembree ..... F04B 9/115 417/403
5,324,175 A * 6/1994 Sorensen ..... F04B 9/1295 417/397
5,863,186 A * 1/1999 Green ..... F04B 9/113 417/244
7,472,544 B1 * 1/2009 Knight ..... F02K 9/50 417/397
8,186,972 B1 * 5/2012 Glauber ..... F04B 9/133 417/399
9,273,681 B2 * 3/2016 Joffroy ..... F04B 25/00
10,030,638 B2 * 7/2018 Bagagli ..... F04B 3/00
10,443,586 B1 * 10/2019 Sahm ..... F04B 49/08
2007/0128053 A1 * 6/2007 Stamper ..... F04B 9/133 417/397
2012/0055145 A1 * 3/2012 Blieske ..... F02C 6/16 60/327
2012/0096845 A1 * 4/2012 Ingersoll ..... F03D 9/28 60/408
2012/0174569 A1 * 7/2012 Ingersoll ..... H02J 15/006 60/415
2012/0282114 A1 * 11/2012 Cannata ..... F04B 35/008 417/266
2015/0322973 A1 * 11/2015 Villar ..... F04B 9/131 91/306
2016/0084241 A1 * 3/2016 Sato ..... F04B 1/2078 417/222.1
2016/0108939 A1 * 4/2016 Trieb ..... F04B 49/022 60/545
2017/0335840 A1 * 11/2017 Hausle ..... F04B 9/109
2019/0195213 A1 * 6/2019 Burrows ..... F04B 39/1046
2020/0018330 A1 * 1/2020 Noord ..... F04F 1/10

FOREIGN PATENT DOCUMENTS

DE 102018109443 A1 10/2019
FR 754983 A 11/1933

OTHER PUBLICATIONS

Office Action for German Application No. 10 2019 133 576.0 dated Aug. 20, 2020; 8pp.

* cited by examiner

COMPRESSOR COMPRISING A FIRST DRIVE PART, A SECOND DRIVE PART, AND A HIGH-PRESSURE PART CONFIGURED TO MOVE IN A COUPLED MANNER BY A PISTON ROD ARRANGEMENT WHEREIN A FIRST CONTROL UNIT AND A SECOND CONTROL UNIT ARE CONFIGURED TO CONTROL A DRIVE FLUID TO THE FIRST AND SECOND DRIVE PARTS

RELATED APPLICATIONS

The present application claims priority of German Application Number 10 2019 133 576.0 filed Dec. 9, 2019, the disclosure of which is hereby incorporated by reference herein in its entirety.

FIELD

The disclosure relates to a compressor and to a method for conveying and compressing a fluid for conveyance into a target system using such a compressor.

BACKGROUND

Compressors increase the pressure of gaseous fluids in one or more stages and are designed inter alia as piston compressors. A piston compressor increases the pressure by reducing the working space. Compressors of said type are known in various embodiments, for example through the brochure "Kompressoren" [compressors], dated November 2007, of the company Maximator GmbH.

DE 10 2018 109 443 A1 discloses a compressor device and a compression method. The compression device has at least one compression space in respectively one compression cylinder for a gas. The at least one compression cylinder is separated spatially by a spacing from the at least two drive cylinders.

DE 1 025 093 A includes a locomotive braking air pump in an upright tandem arrangement that is driven by a piston steam engine without a flywheel.

A piston-type pneumatic circulating pump is described in CN 103062011 A.

The compressors are proven in operation. The compression is realized via the piston compressor principle, in the case of which the pressure transmission results from the ratio of the area of the drive piston to the area of the high-pressure piston. The high pressure is built up in one or more high-pressure cylinders. Movement of the high-pressure piston out of the pressure cylinder results in the formation of a negative pressure, and the suction valve allows fluid for conveyance to flow in. The fluid for conveyance is the gaseous fluid to be conveyed and compressed by the compressor, for example argon, helium, hydrogen or nitrogen. Movement of the high-pressure piston into the pressure cylinder results in the fluid for conveyance that has flowed in being compressed. The suction valve closes and the pressure valve opens.

The transmission ratio can be almost doubled by doubling the area of the drive surface. For this purpose, two drive pistons are installed, and a larger pressure can be generated. This is necessary if the drive pressure is nominally insufficient to generate the desired target pressure or end pressure based on the transmission ratio.

The design of the compressor is realized according to the maximum operating pressure. Here, use is often made of compressors having two drive parts, wherein the first drive part has a first drive piston which is movable in a first drive chamber, and the second drive part has a second drive piston which is movable in a second drive chamber. The first drive piston and the second drive piston are each able to be subjected to a drive fluid on alternate sides in a manner controlled via a control unit. The first drive piston, the second drive piston and the high-pressure piston are coupled and jointly movable via a piston rod arrangement.

During the compression, the maximum transmission ratio is required only in the last third of the pressure build-up. Nevertheless, both drive chambers are filled with drive fluid. There appears to be a need for improvement here from ecological and economic aspects.

SUMMARY

Proceeding from the above, the disclosure includes an object of providing an operationally efficient compressor, for which the consumption of drive fluid is reduced while the power is maintained, and of specifying an effective and more cost-effective method for conveying and compressing a fluid for conveyance into a target system.

According to the disclosure, the second drive part is assigned a second control unit, which is arranged after the first control unit. Via the second control unit, the subjecting of the second drive piston to drive fluid is able to be activated, wherein the subjecting of the second drive piston to drive fluid is activatable in a manner dependent on an actual pressure in a target system on the high-pressure side of the at least one first high-pressure part.

The disclosure provides a double-stage piston compressor for which the previously high or increased consumption of drive fluid is reduced and the power of the double-stage piston compressor is nevertheless utilized. Double-stage means that the compressor has two drive parts having two drive pistons and has at least one high-pressure part. The compressor is a double-acting compressor which has two drive parts and two high-pressure parts, wherein the drive pistons of the two drive parts and the high-pressure pistons of the two high-pressure parts are jointly movable in a manner coupled via a piston rod arrangement.

Pilot valves are installed in the compressor arrangement. The pilot valves serve for end-position switchover by the drive pistons. The pilot valves are actuated in the end positions by the drive pistons and pass control pulses on to a control slide. The pilot valves thus aerate and de-aerate the actuation space of the control slide. In this way, the control slide is pushed from one end position into the other end position.

The control slide is a constituent part of the first control unit. The control slide is an internally actuated four/two-way valve. The control slide serves for alternate subjecting of the top side and bottom side of the drive pistons to drive fluid. This is generally compressed air. The actuation of the control slide is realized via the pilot valves and ensures that the drive medium or the drive air passes to the respectively opposite side of the drive piston.

The drive parts serve for receiving the drive medium and actuate the high-pressure piston(s) of the compressor via a piston rod and, in this way, compress the respective fluid for conveyance to a higher pressure.

The high-pressure part(s) of the compressor is/are respectively assigned a compressor head, which has inlet and outlet valves. The compressor head closes off the compression space, that is to say the pressure cylinder of the high-pressure part, and separates the compression space spatially from the ambient pressure. The compressor head contains the inlet and outlet valves. By way of said inlet and outlet valves, the fluid for conveyance to be compressed passes into the compression space of the compressor and out of the compression space again.

The high-pressure part(s) of the compressor serves/serve for compression of the respective fluid for conveyance. The high-pressure part is made substantially of the pressure cylinder, the compressor head, which has inlet and outlet valves, and the high-pressure piston, which has sealing and guide elements.

The provision of a supply to the second drive part is activatable and deactivatable via a switching logic. The disclosure incorporates the finding that, over two thirds of the filling and compression process, there is no need for both drive chambers for the conveyance and compression of the fluid for conveyance. The second drive part is activated and the second drive piston is subjected to drive fluid only from a specific actual pressure in the target system on the high-pressure side. This is generally first used in the last third of the compression process, in order to build up or to obtain the desired end pressure. The switchover is realized in a manner dependent on the pressure. The occurrence of force equilibrium between the drive pressure and end pressure results in the second drive piston in the second drive part being additionally activated, and the compressor is able to continue to compress the fluid for conveyance until attainment of the target pressure.

In order to control the provision of a supply to the second drive chamber, the continuous connection of the two drive chambers is interrupted. The compressor is firstly operated only with one drive chamber in a first compression stage. The second drive chamber is activated according to requirement. For this purpose, the second control unit is arranged after the first control unit.

The first control unit and the second control unit are integrated into a control mechanism which controls the system or the compressor and the method in such a way that all the operations are performed in chronological and logical order.

In terms of practical use, the second control unit has two three-way valves.

One aspect of the disclosure provides that each three-way valve has an outlet and a sound damper arranged thereafter. The sound dampers serve for noise-reduced discharge of the expanding drive medium from the compressor. After use, the drive medium exits the compressor via the sound dampers. By way of the additional sound dampers, which are arranged after the two three-way valves, sound damping is realized in both compression stages of the compressor.

The compressor according to the disclosure has two drive parts. These are normally driven by compressed air. The compressor has a wide variety of applications, such as filling processes, testing processes, decanting processes or else emptying processes.

The implementation of the switching logic provided according to the disclosure may be realized manually, pneumatically or electrically.

For manual actuation of the second control unit, manual valves are installed. For the compression process, this means that the compressor runs with the first drive piston until the drive piston stops on account of force equilibrium on the drive side and the high-pressure side (standstill pressure). Then, for example by means of a ball valve, there is a switchover to the two-piston drive, that is to say, in addition to the first drive piston, the second drive chamber and the second drive piston arranged therein are subjected to drive fluid.

For the pneumatic actuation of the second control unit, this has pneumatically actuatable valves. These may be actuated via pressure switches, so that a switchover between the one-piston drive and the two-piston drive is possible according to operating pressure.

For electrical actuation of the second control unit, electrically actuatable valves are installed. These may also be retrofitted in existing programmable logic controllers. The system comprises integrated pressure transducers, whose information is used to switch between one-piston drive and two-piston drive with memory-programmable control. In the programmable logic controller, switchover pressures are stored, and there is a switch to the efficient mode via solenoid valves of the compressor.

A method according to the disclosure for conveying and compressing a fluid for conveyance into a target system uses a compressor according to the disclosure. The supply of drive fluid to the individual drive chambers or to the drive pistons arranged there is activated or deactivated via the switching logic provided according to the disclosure. In a first compression stage, the first drive piston of the first drive part is subjected to drive fluid and fluid for conveyance is conveyed into the target system until the occurrence of force equilibrium on the drive side and the high-pressure side. Then, in a second compression stage, the second drive part is activated and, in addition to the first drive piston, the second drive piston is subjected to drive fluid and fluid for conveyance is conveyed into the target system until attainment of a target pressure or the desired end pressure.

The conveyance and compression of a fluid for conveyance into a target system may involve for example a process of decanting or introducing a gaseous fluid into a container, for example into a pressurized-gas vessel. The conveyance and compression of the fluid may however also involve the provision of a supply to gas internal pressure systems or test and control units for compressed air and gases, as well as systems for filling of airbag gas containers. A target system may also be a test stand for pressure tests.

The disclosure uses the drive of the compressor via a drive piston during approximately two thirds of a decanting or filling process. This is the first compression stage. In the second compression stage, use is made of all the drive pistons, both the one in the first drive part and the one in the second drive part, specifically for the remaining part of the decanting or filling process, that is to say the conveyance and compression of the fluid for conveyance into a target system according to the target pressure and the target quantity for conveyance. In this way, the relatively high costs for the drive fluid and also the high consumption of drive fluid are reduced. Air or compressed air are used as drive fluid. The consumption of drive fluid can be reduced by up to 40%. Also a reduction in the filling time for the conveyance and compression of the fluid for conveyance into the target system can be reduced by up to 20%. Also, existing compressors can, with little outlay, be converted or retrofitted and equipped according to the disclosure. As a result of the reduction in the consumption of drive fluid as well as the reduction in process times, the operating costs can be lowered and both economic and ecological advantages are obtained.

BRIEF DESCRIPTION OF THE DRAWINGS

The disclosure is described in more detail below on the basis of drawings. In the drawings.

The figures use the same reference numerals for identical or similar components, even when there is no repeated description on grounds of simplification.

DETAILED DESCRIPTION

Figure 1:
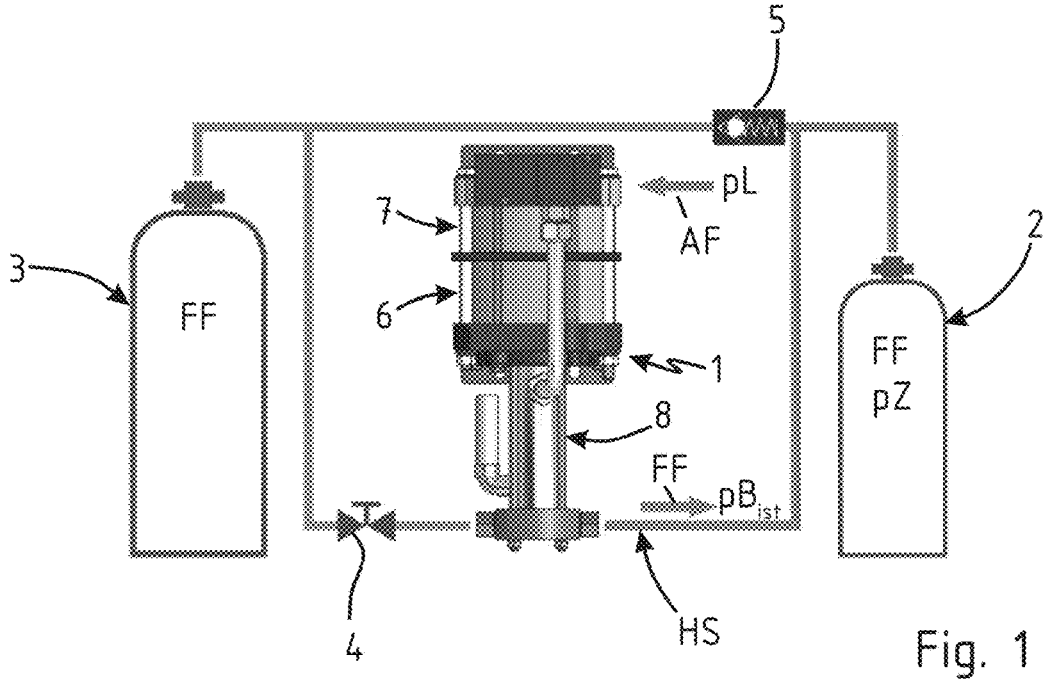
FIG. 1 shows, in technically schematic form, a compressor according to the disclosure and the functional illustration for conveying and compressing a fluid for conveyance into a target system according to at least one embodiment.

FIG. 1 illustrates, in technically schematic form, the principle of a compressor arrangement, with a compressor 1, for conveying and compressing a fluid for conveyance (arrow FF) into a target system 2. The target system 2 is a target container. The fluid for conveyance FF is provided in a source system 3 in the form of a source container. The drive of the compressor 1 is realized via a drive fluid (arrow AF). This is compressed air in this case. The drive fluid AF is provided with a drive pressure pL and is fed to the compressor 1. The compressor 1 compresses the fluid for conveyance FF to an operating pressure pB and transfers the fluid for conveyance FF into the target system 2. A shut-off element 4 and a check valve 5 are integrated into the compressor arrangement.

The compressor 1 has a first drive part 6 and a second drive part 7 and also a high-pressure part 8.

The compressor 1 works according to the principle of a pressure transmitter. Further details of a compressor 1 are explained on the basis of FIG. 2. The compressor 1 as illustrated in FIG. 1 corresponds, in terms of basic construction, to the compressor 1 explained below on the basis of FIG. 2, albeit having only one first high-pressure part 8.

Figure 2:
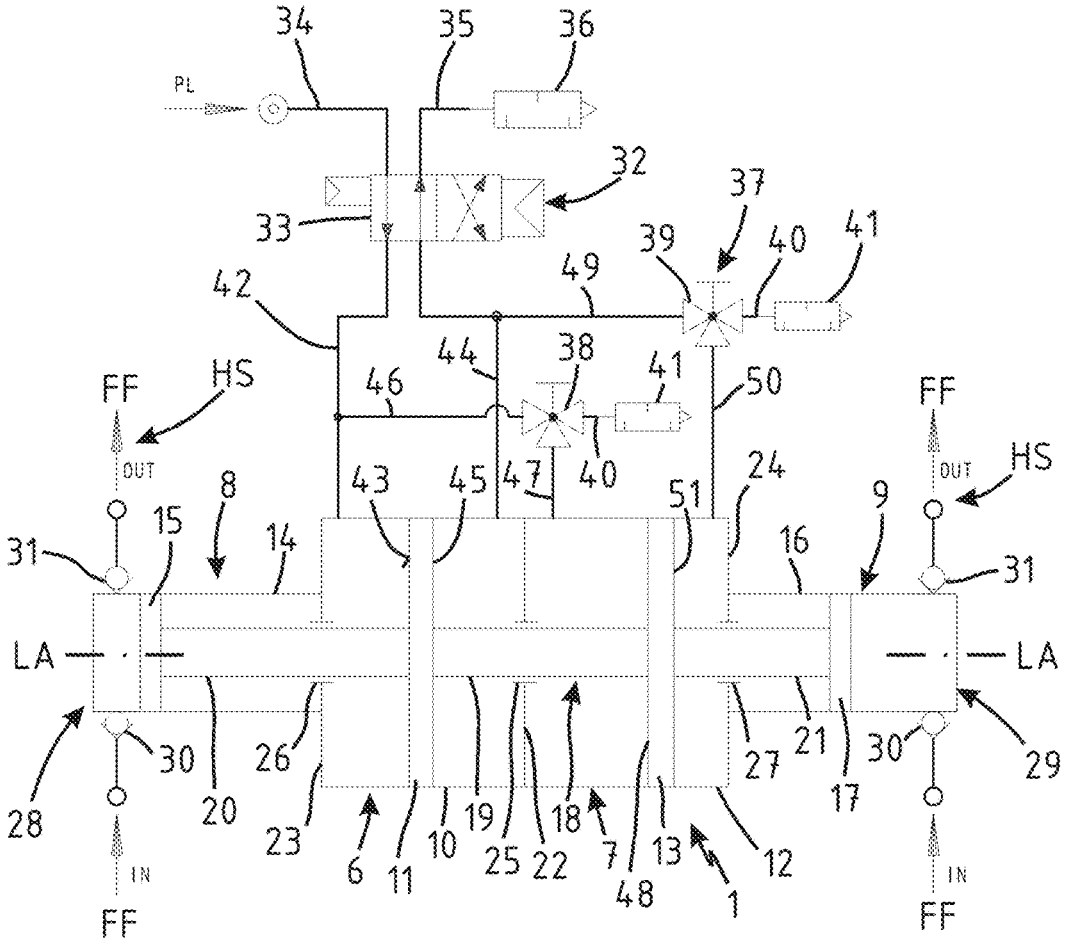
FIG. 2 shows at least one embodiment of a double-acting compressor, and the connection diagram thereof.

The compressor 1 as per FIG. 2 has a first drive part 6 and a second drive part 7 and also a first high-pressure part 8 and a second high-pressure part 9. The first drive part 6 has a first drive chamber 10 having a first drive piston 11 which is movable longitudinally therein. The second drive part 7 has a second drive chamber 12 having a second drive piston 13 which is movable longitudinally therein. The first high-pressure part 8 has a first pressure cylinder 14 having a first high-pressure piston 15 which is movable therein. The second high-pressure part 9 has a second pressure cylinder 16 having a second high-pressure piston 17 which is movable therein.

The first drive piston 11 and the second drive piston 13 and also the two high-pressure pistons 15 and 17 are jointly movable in an axial direction in a manner coupled via a piston rod arrangement 18. The piston rod arrangement 18 comprises piston rods 19, 20 and 21. The piston rod 19 is incorporated between the first drive piston 11 and the second drive piston 13. The piston rod 20 connects the first drive piston 11 and the first high-pressure piston 15. The piston rod 21 connects the second drive piston 13 and the second high-pressure piston 17. The piston rods 19, 20, 21 of the piston rod arrangement 18 extend in alignment along a common longitudinal axis LA.

The first drive chamber 10 and the second drive chamber 12 are separated by a central wall 22. The two high-pressure parts 8 and 9 are respectively flange-mounted onto the end walls 23 and 24 of the first drive part 6 and second drive part 7. The piston rod 19 passes through an opening 25 in the central wall 22 and is guided there. The piston rods 20, 21 respectively pass through openings 26 and 27 in the end walls 23 and 24.

The high-pressure parts 8 and 9 or the pressure cylinders 14, 16 thereof have, respectively at an end side, a compressor head 28, 29, which is merely indicated in the illustration in FIG. 2. A compressor head 28, 29 closes off the compression space situated in the pressure cylinders 14, 16 and separates the compression space spatially from the ambient pressure. Each compressor head 28, 29 contains an inlet valve 30 and an outlet valve 31.

The first drive piston 11 and the second drive piston 13 are each able to be subjected to drive fluid AF on alternate sides in a manner controlled via a first control unit 32. The control unit 32 comprises a control slide in the form of a four/two-way valve 33. The feeding of drive fluid AF at an operating pressure pL is realized via a connection 34. The discharge of expanded working fluid AF is realized via an outlet 35 and a sound damper 36 arranged thereafter.

A second control unit 37 is assigned to the second drive part 7. The second control unit 37 is arranged after the first control unit 32. The subjecting of the second drive chamber 12 and the second drive piston 13 to drive fluid AF is able to be activated or deactivated via the second control unit 37. The second control unit 37 is designed to interrupt or to activate the supply of drive fluid AF to the second drive chamber 12 separately in a controlled manner. In this way, the compressor 1 can be operated with only the first drive chamber 10. The second drive chamber 12 is additionally activated according to requirement. The subjecting of the second drive piston 13 to drive fluid AF is activatable in a manner dependent on an actual pressure $pB_{actual}$ in the target system 2 on the high-pressure side HS of the high-pressure part(s) 8, 9.

The second control unit 37 has two three-way valves 38, 39. The three-way valves 38, 39 each have an outlet 40 with a sound damper 41 integrated or arranged thereafter.

The control slide or the four/two-way valve 33 of the first control unit 32 is, via a line path 42, connected to that part of the first drive chamber 10 which is at the top side 43, facing the first high-pressure piston 15, of the first drive piston 11. A line path 44 connects the four/two-way valve 33 to that part of the first drive chamber 10 which is at the bottom side 45 of the first drive piston 11. The first three-way valve 38 is connected to the line path 42 via a line path 46, and, via a line path 47, is connected to that part of the second drive chamber 12 which is at the bottom side 48 of the second drive piston 13. The second three-way valve 39 is connected to the line path 44 via a line path 49, and, via a line path 50, is connected to that part of the second drive chamber 12 which is at the top side 51 of the second drive piston 13.

In a first compression stage, the compressor 1 is run in one-piston mode. This means that the first drive chamber 10 and the first drive piston 11 of the first drive part 6 are subjected to drive fluid AF.

Figure 3:
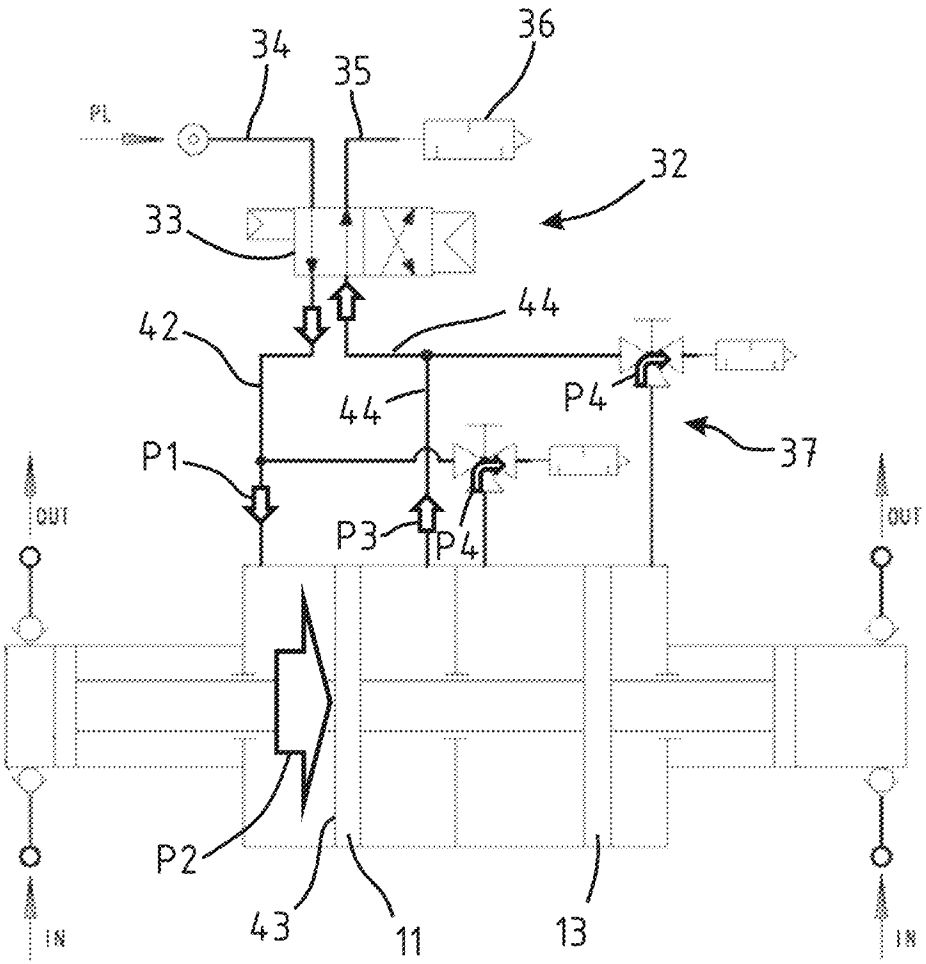
FIGS. 3 to 6 show the compressor arrangement as per the illustration in FIG. 2 with the illustration of four switching states and drive modes.

The control slide or the four/two-way valve 33 guides the drive fluid AF to the top side 43 and to the bottom side 45 of the first drive piston 11 in an alternating manner. The drive fluid AF flows from the connection 34 at the drive pressure pL through the four/two-way valve 33 and to the top side 43 of the first drive piston 11 according to the arrows P1, P2. The four/two-way valve 33 is in the switching position illustrated in FIG. 3. The first drive piston 11 moves to the right in the plane of the figure in the first drive part 6. The piston rod arrangement 18 and the second drive piston 13 and also the first high-pressure piston 15 and the second high-pressure piston 17 are moved together therewith. The first high-pressure piston 15 of the first high-pressure part 8 performs a suction stroke, the inlet valve 30 opens and the fluid for conveyance FF to be conveyed and compressed flows into the first pressure cylinder 14. A pressure stroke is performed on the other side in the second high-pressure part 9. During the pressure stroke, the inlet valve 30 in the compressor head 29 is in a closed state. The fluid for conveyance FF situated in the second pressure cylinder 16 is compressed by way of the movement of the second high-pressure piston 17, the outlet valve 31 is opened and the compressed fluid for conveyance FF flows into the target system 2 on the high-pressure side HS.

The feeding of fluid for conveyance FF via the inlet valves 30 is respectively indicated by the arrows IN in FIGS. 2 to 6. The discharge of the compressed fluid for conveyance FF on the high-pressure side HS and the transfer into a target system 2 are indicated by the arrows OUT.

Via the line path 44, air can be discharged from the first drive chamber 10 via the four/two-way valve 33 and the outlet 35 with sound damper 36 arranged thereafter according to the arrows P3. The two three-way valves 38, 39 are open toward the outlet 40, and so, during the movement of the first drive piston 11 and the second drive piston 13, air can be discharged from the second drive chamber 12 and the three-way valves 38, 39 according to the arrows P4.

Figure 4:
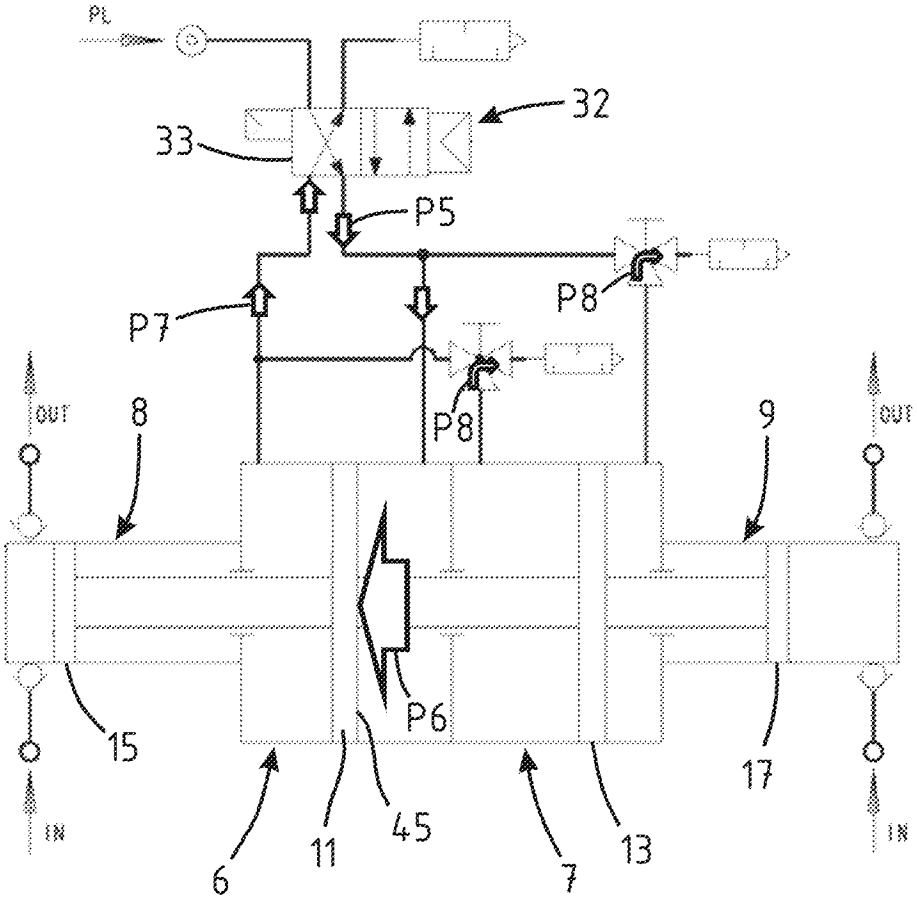

If the first drive piston 11 has moved to the right to an end position of the first drive piston 11 in the first drive chamber 10, a pilot valve (not illustrated here) opens. The pilot valve belongs to the first control unit 32. Drive fluid AF passes to the control slide of the control unit 32, and the four/two-way valve 33 is switched into the opposite switching position (FIG. 4).

Drive fluid AF then flows to the bottom side 45 of the first drive piston 11 according to the arrows P5, P6. The drive piston 11, as well as the second drive piston 13 and the first high-pressure piston 15 and the second high-pressure piston 17, moves to the left in the plane of the figure in FIG. 4 toward the opposite side. The pressure stroke is then performed in the first high-pressure part 8. A suction stroke is in turn performed on the other side in the second high-pressure part 9.

During the movement of the first drive piston 11 to the left, air situated in the first drive chamber 10 can escape via the four/two-way valve 33 and the outlet 35 and the sound damper 36 according to the arrows P7. The second drive chamber 12 is aerated via the three-way valves 38, 39, with the result that air can escape according to the arrows P8.

In this way, fluid for conveyance FF is conveyed from the source system 3 until the occurrence of force equilibrium on the drive side and the high-pressure side HS. The compressor 1 is consequently operated via the first drive part 6 and the first drive piston 11 over two thirds of the filling process. Only in the last third of the conveyance and compression process is the total force of the two drive pistons 11 and 13 required. The second drive part 7 is activated, and the second drive piston 13 is additionally subjected to drive fluid AF, in a manner dependent on the actual pressure $pB_{actual}$ resulting from force equilibrium on the drive side and on the high-pressure side HS. The compressor 1 then runs in two-piston mode and conveys and compresses fluid for conveyance FF into the target system 2 until attainment of the target pressure pZ.

Figure 5:
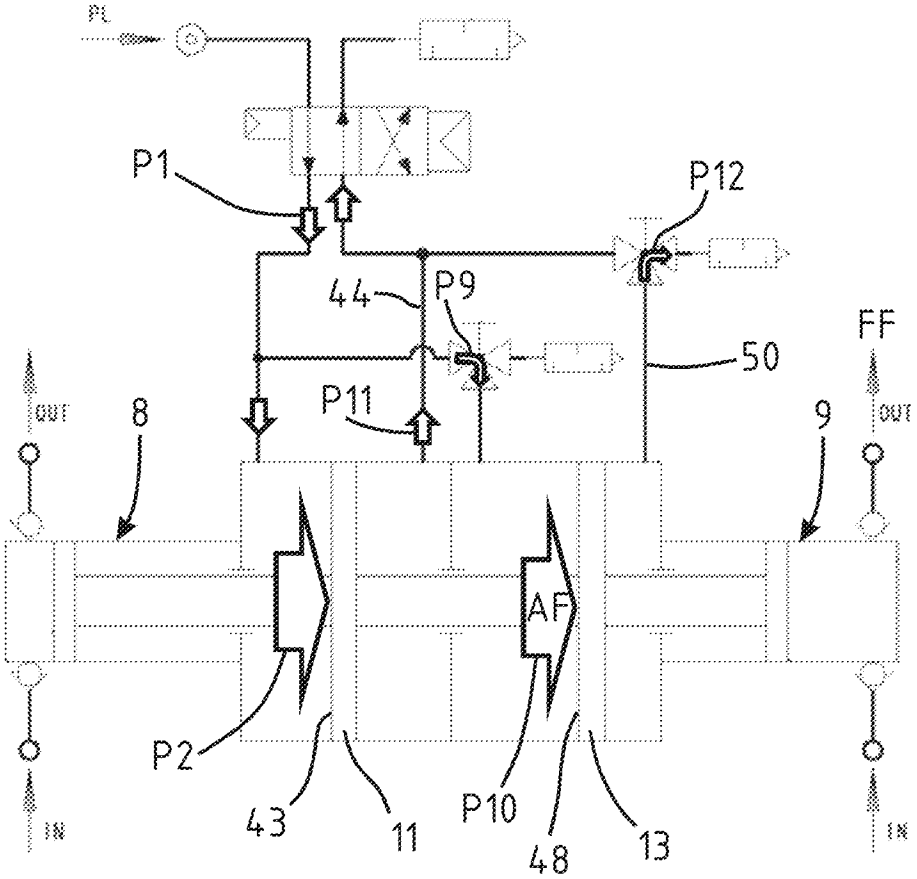

As can be seen in FIG. 5, in this second compression stage, drive fluid AF is guided to the top side 43 of the first drive piston 11 according to the arrows P1, P2 and, via the line paths 46, 47 and the three-way valve 38, to the bottom side 48 of the second drive piston 13 according to the arrows P9, P10. Displaced air on the opposite sides of the drive pistons 11 and 13 is discharged from the system via the line path 44 and the line path 50 and the second three-way valve 39, respectively (arrows P11, P12). A pressure stroke is performed in the second high-pressure part 9. A suction stroke is performed in the first high-pressure part 8.

Figure 6:
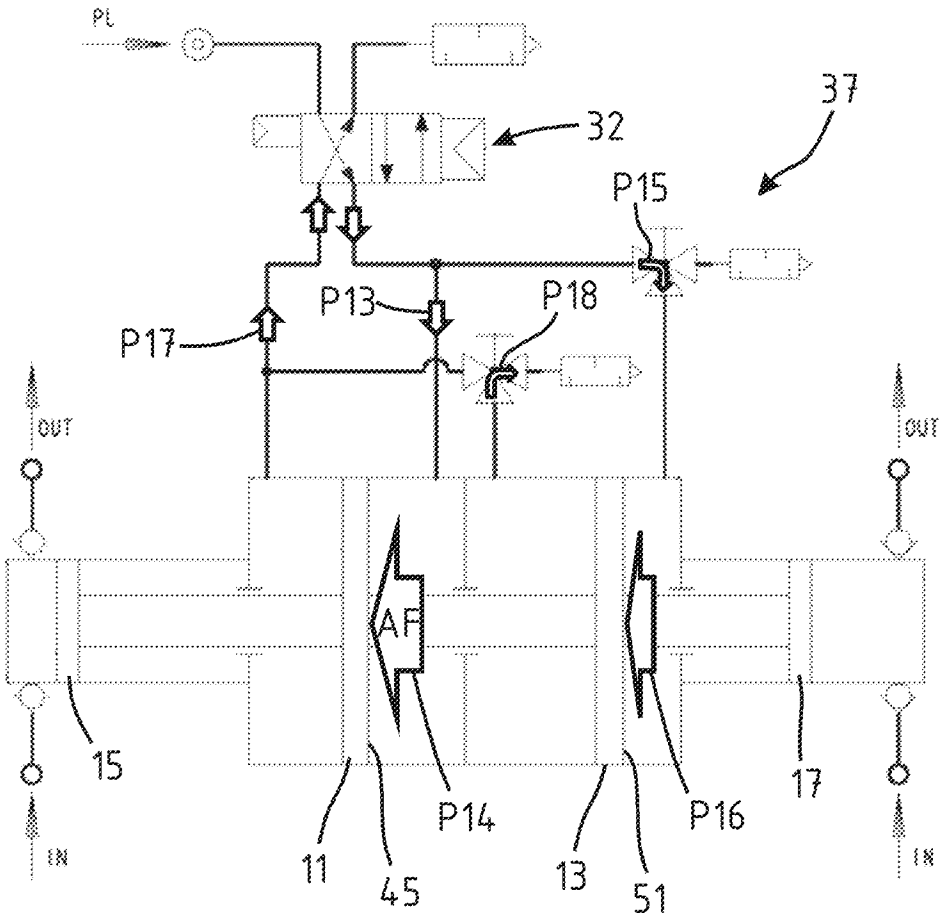

After the end position is reached, the system in turn effects a reversal. Both the first control unit 32 and the second control unit 37 perform a switchover, and working fluid AF can, as illustrated in FIG. 6, flow to the bottom side 45 of the first drive piston 11 and to the top side 51 of the second drive piston 13 according to the arrows P13, P14 and P15, P16, respectively, and move the arrangement composed of first drive piston 11 and second drive piston 13 and also first high-pressure piston 15 and second high-pressure piston 17 to the left in the plane of the figure in FIG. 6. Air can escape from the system via the arrows P17 and P18.

In the first compression stage, the compressor 1 is operated only via the first drive part 6. In this way, the consumption of drive fluid AF can be reduced. Only in the second compression stage is the second drive part 7 activated, in order to obtain the desired end pressure or target pressure pZ during the compression process. The switchover is realized in a manner dependent on an actual pressure $pB_{actual}$ on the high-pressure side HS. A very high potential for reduction of the consumption costs for drive fluid AF and also in the filling time is possible, such as in the case of a large container volume and low entry pressures. By changing the activation pressure, that is to say the pressure at which the second drive part 7 is activated, with conditions otherwise the same, priority can be given, in a range, to the filling time or the consumption costs for drive fluid AF.

The foregoing description of some embodiments of the disclosure has been presented for purposes of illustration and description. The description is not intended to be exhaustive or to limit the disclosure to the precise form disclosed, and modifications and variations are possible in light of the above teachings. The specifically described embodiments explain the principles and practical applications to enable one ordinarily skilled in the art to utilize various embodiments and with various modifications as are suited to the particular use contemplated. It should be understood that various changes, substitutions and alterations can be made hereto without departing from the spirit and scope of the disclosure.

The invention claimed is:

1. A compressor comprising:

a first drive part, wherein the first drive part comprises a first drive piston movable in a first drive chamber;

a second drive part, wherein the second drive part comprises a second drive piston movable in a second drive chamber;

a first high-pressure part, wherein the first high-pressure part comprises a high-pressure piston movable in a first pressure cylinder;

a first control unit configured to control a drive fluid for operating each of the first drive piston and the second drive piston;

a piston rod arrangement configured to move the first drive piston, the second drive piston and the high-pressure piston in a coupled manner;

a second control unit downstream of the first control unit, wherein the second control unit is configured to activate the drive fluid for the second drive part based on an actual pressure in a target system on a high-pressure side of the high-pressure part.

2. The compressor according to claim 1, wherein the second control unit comprises two three-way valves.

3. The compressor according to claim 2, wherein each of the two three-way valves comprises an outlet and a sound damper downstream of the outlet.

4. The compressor according to claim 1, wherein the second control unit is actuatable manually, pneumatically or electrically.

5. A method of conveying and compressing a fluid for conveyance into a target system using a compressor, the compressor comprising:

a first drive part, wherein the first drive part comprises a first drive piston movable in a first drive chamber;

a second drive part, wherein the second drive part comprises a second drive piston movable in a second drive chamber;

a first high-pressure part, wherein the first high-pressure part comprises a high-pressure piston movable in a first pressure cylinder;

a first control unit configured to control a drive fluid for operating each of the first drive piston and the second drive piston;

a piston rod arrangement configured to move the first drive piston, the second drive piston and the high-pressure piston in a coupled manner; and a second control unit downstream of the first control unit, wherein the second control unit is configured to activate the drive fluid for the second drive part based on an actual pressure in a target system on a high-pressure side of the high-pressure part;

the method comprising:

in a first compression stage, subjecting the first drive piston of the first drive part to the drive fluid, and conveying fluid for conveyance into the target system until an occurrence of force equilibrium on a drive side and the high-pressure side, and in a second compression stage, activating the second drive part and, in addition to the first drive piston, subjecting the second drive piston to drive fluid and conveying the fluid for conveyance into the target system until attainment of a target pressure.

* * * * *